US010714872B2

(12) United States Patent
Maesoba et al.

(10) Patent No.: US 10,714,872 B2
(45) **Date of Patent: *Jul. 14, 2020**

(54) CONNECTOR STRUCTURE ENABLING REPLACEMENT OF A SHIELD TWISTED PAIR CABLE AND AN UNSHIELD TWISTED PAIR CABLE WITHOUT LARGE STRUCTURAL CHANGE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/340,570

(22) PCT Filed: Sep. 21, 2017

(86) PCT No.: PCT/JP2017/034005
§ 371 (c)(1),
(2) Date: Apr. 9, 2019

(87) PCT Pub. No.: WO2018/070203
PCT Pub. Date: Apr. 19, 2018

(65) Prior Publication Data

US 2019/0312388 A1 Oct. 10, 2019

(30) Foreign Application Priority Data

Oct. 12, 2016 (JP) ..... 2016-200513

(51) Int. Cl.
*H01R 13/6463* (2011.01)
*H01R 13/6474* (2011.01)
(Continued)

(52) U.S. Cl.
CPC ..... *H01R 13/6463* (2013.01); *H01R 13/6474* (2013.01); *H01R 13/6585* (2013.01); *H01R 24/60* (2013.01)

(58) Field of Classification Search
CPC . H01R 13/6463; H01R 13/6474; H01R 24/60
See application file for complete search history.

(56) References Cited

U.S. PATENT DOCUMENTS 6,280,209 B1 8/2001 Bassler et al.
7,909,647 B2 * 3/2011 Kawaguchi ..... H01R 9/035 439/585

(Continued)

FOREIGN PATENT DOCUMENTS

JP 2009-135122 6/2009
JP 5087487 12/2012

(Continued)

OTHER PUBLICATIONS

International Search Report.

*Primary Examiner* — Tho D Ta
(74) *Attorney, Agent, or Firm* — Gerald E. Hespos; Michael J. Porco; Mathew T. Hespos

(57) ABSTRACT

A connector structure enables replacement of an STP cable (10B) and a UTP cable (10A) without a large structural change. UTP connection terminals (21A) connected to respective wires (11) of the UTP cable (10A) are accommodated in accommodating portions (26) of a UTP dielectric (22A) such that insertion areas (53) for male terminals (91) are close to each other in a width direction. STP connection terminals (21B) connected to respective wires (11) of the (Continued)

STP cable (10B) are accommodated in accommodating portions (26) of an STP dielectric (22B) such that insertion areas (53) for male terminals (91) are farther apart in the width direction than in the case of the UTP connection terminals (21A). The UTP connection terminals and the STP connection terminals that are accommodated in the accommodating portions (26) have protrusions (34) that are oriented in the same direction when.

2 Claims, 21 Drawing Sheets

(51) Int. Cl.
*H01R 13/6585* (2011.01)
*H01R 24/60* (2011.01)

(56) References Cited

U.S. PATENT DOCUMENTS

| | | | | |
|---|---|---|---|---|
| 9,502,158 | B2 * | 11/2016 | Bes | H01R 13/4361 |
| 2011/0136391 | A1 | 6/2011 | Kameyama | |
| 2015/0200486 | A1 | 7/2015 | Yagi et al. | |
| 2017/0352989 | A1 | 12/2017 | Takahashi | |

FOREIGN PATENT DOCUMENTS

| | | |
|---|---|---|
| JP | 5333632 | 11/2013 |
| JP | 2015-53194 | 3/2015 |
| JP | 2015-149189 | 8/2015 |
| JP | 2016-39046 | 3/2016 |
| JP | 2016-115625 | 6/2018 |
| WO | 2016/132855 | 8/2016 |

* cited by examiner

CONNECTOR STRUCTURE ENABLING REPLACEMENT OF A SHIELD TWISTED PAIR CABLE AND AN UNSHIELD TWISTED PAIR CABLE WITHOUT LARGE STRUCTURAL CHANGE

BACKGROUND

Field of the Invention

The invention relates to a connector structure.

Related Art

A twisted pair cable is formed by twisting wires and suitably is used in an in-vehicle network and the like since the twisted pair cable is affected less by noise and having less noise radiation than mere parallel wires. STP (Shield Twisted Pair) cables and UTP (Unshield Twisted Pair) cables are known as twisted pair cables. The STP cables have their wires surrounded by a shield conductor, and have a strong resistance to noise.

Japanese Patent No. 5333632 discloses a connector with inner conductor terminals to be connected to an end part of an STP cable, an inner housing (dielectric) for accommodating the inner conductor terminals, a shield shell connected to a shield conductor of the STP cable and surrounding the inner housing and an outer housing for accommodating the shield shell.

Japanese Patent No. 5087487 discloses a connector with connection terminals to be connected to an end part of a UTP cable and a connector body (dielectric) including a terminal accommodating portion for accommodating the connection terminals.

The connectors of Japanese Patent No. 5333632 and Japanese Patent No. 5087487 have such a common configuration that each wire of the UTP cable and STP cable is connected to a terminal and each terminal is accommodated in the dielectric. If it is made possible to replace the STP cable by the UTP cable or replace the UTP cable by the STP cable utilizing common structural parts in the respective connectors, a mold design is facilitated and cost can be reduced. However, there is no compatibility between the UTP cable and the STP cable and impedances of the UTP cable and the STP cable are different. Thus, sufficient attention has to be paid to this point.

The invention was completed on the basis of the above situation and aims to provide a connector structure enabling the replacement of an STP cable and a UTP cable without making a large structural change.

SUMMARY

The invention is directed to a connector structure with UTP connection terminals each including a box and a protrusion. A male terminal is inserted in and connected to the box. The protrusion projects out of the box. The UTP connection terminals are connected to respective wires of a UTP cable. An STP connection terminal also includes a box and a protrusion, and a male terminal is inserted in and connected to the box. The protrusion projects out of the box. The STP connection terminals are connected to respective wires of an STP cable. A UTP dielectric includes accommodating portions for accommodating the UTP connection terminals. An STP dielectric includes accommodating portions for accommodating the STP connection terminals. A pair of the accommodating portions of the UTP dielectric and a pair of the accommodating portions of the STP dielectric are arranged in a width direction perpendicular to an inserting direction of the male terminals. The UTP connection terminals are arranged in the pair of accommodating portions of the UTP dielectric such that insertion areas for the male terminals in the boxes are close to each other in the width direction. The STP connection terminals are arranged in the pair of accommodating portions of the STP dielectric such that insertion areas for the male terminals in the boxes are spaced farther apart in the width direction than in the case of the UTP connection terminals. The UTP connection terminals and the STP connection terminals are set such that all of the protrusions are oriented in the same direction in a state accommodated in the accommodating portions.

When the UTP connection terminals (terminals to be connected to the respective wires of the UTP cable) are accommodated in the accommodating portions and the male terminals are inserted and connected into the insertion areas for the male terminals, the male terminals are arranged close to each other in the width direction. Thus, impedance can be reduced. On the other hand, when the STP connection terminals (terminals to be connected to the respective wires of the STP cable) are accommodated in the accommodating portions and the male terminals are inserted in and connected to the insertion areas for the male terminals, the male terminals are arranged farther apart in the width direction than in the case of the UTP connection terminals. Thus, impedance can be increased. In this way, the impedance can be adjusted between the UTP cable and the STP cable. In adjusting the impedance, it is sufficient to adjust a separation distance in the width direction of the insertion areas for the male terminals. Thus, it is not necessary to make a large structural change and the UTP cable and the STP cable can be replaced easily. Further, when the UTP connection terminals and the STP connection terminals are accommodated respectively in the corresponding accommodating portions, the protrusions all are oriented in the same direction. Thus, the respective connection terminals can be mounted in the same direction into the accommodating portions and work efficiency at the time of mounting the terminals is good.

A receiving portion and a resilient contact piece facing the receiving portion may be arranged in the box. The resilient contact piece may project farther into the box than the receiving portion and the male terminal may be sandwiched between the receiving portion and the resilient contact piece. The UTP connection terminals may be accommodated in the accommodating portions of the UTP dielectric such that the receiving portions are located on inner sides proximate in the width direction and the resilient contact pieces are located on outer sides spaced apart in the width direction. The STP connection terminals may be accommodated in the accommodating portions of the STP dielectric such that the receiving portions are located on outer sides spaced apart in the width direction and the resilient contact pieces are located on inner side proximate in the width direction. According to this configuration, impedance can be adjusted easily merely by reversing a positional relationship of the resilient contact pieces and the receiving portions between the UTP cable side and the STP cable side.

DETAILED DESCRIPTION

Figure 1:
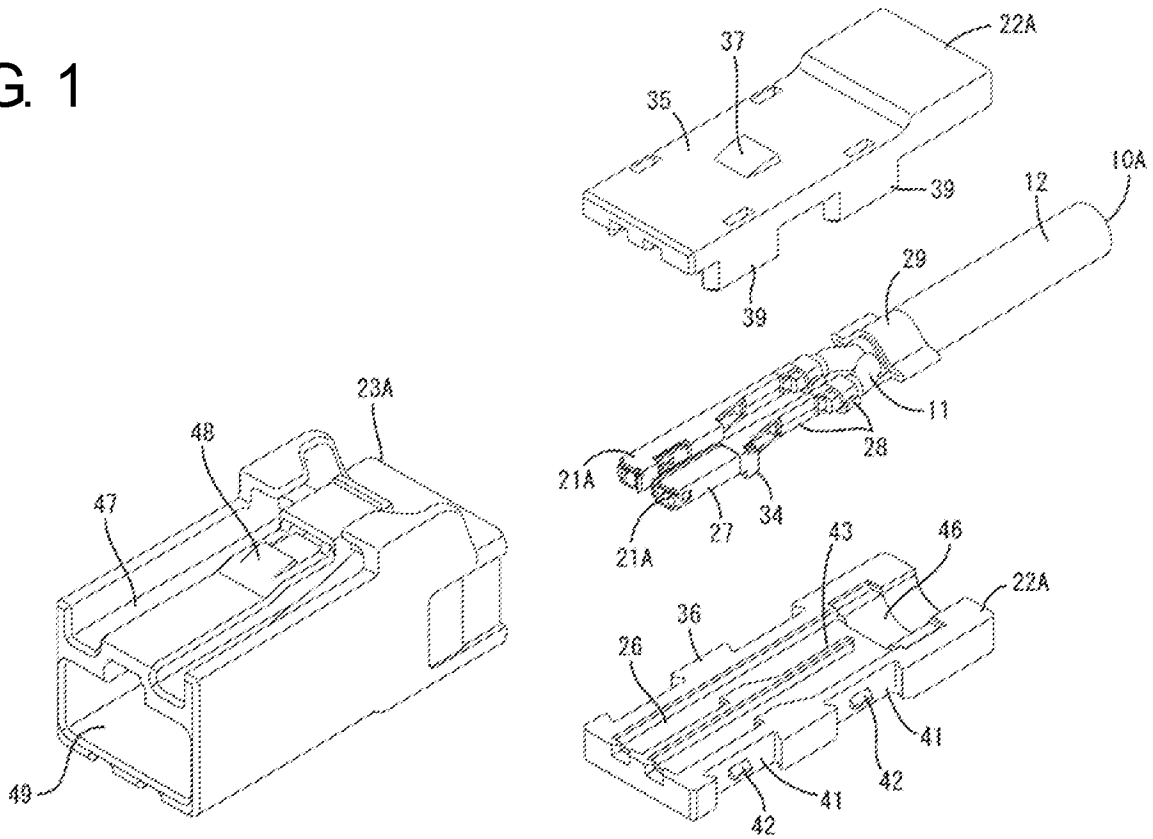
FIG. 1 is an exploded perspective view of a UTP connector in a connector structure of one embodiment of the invention.
Figure 4:
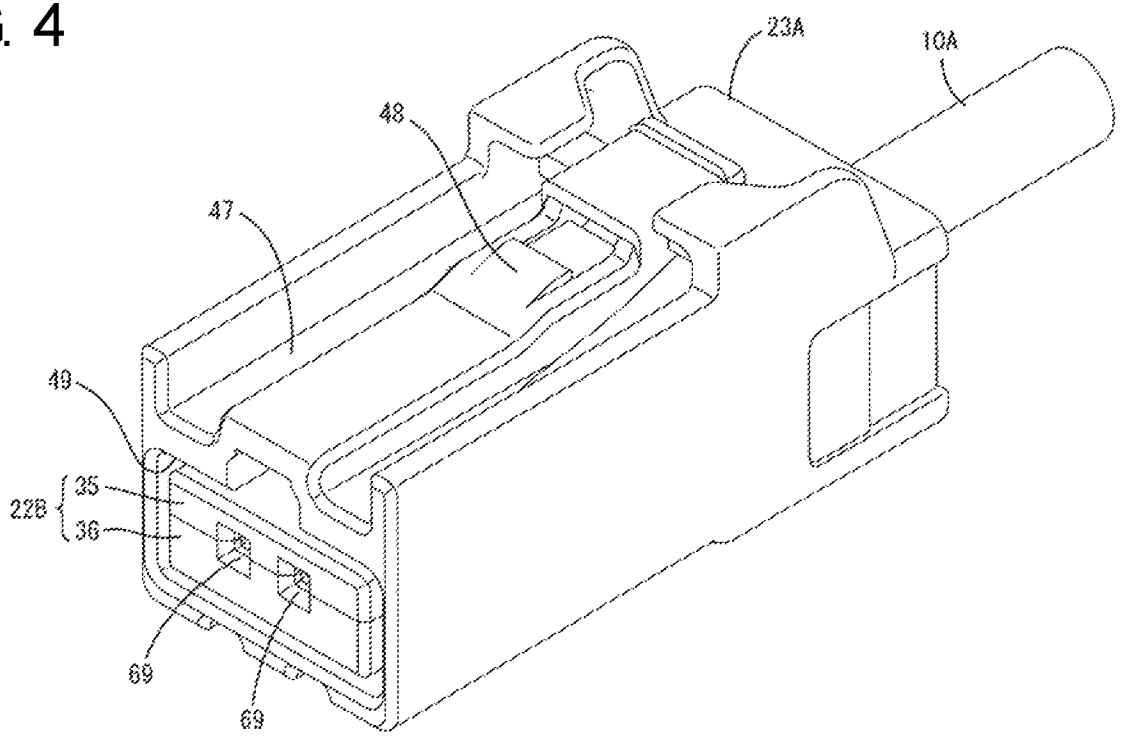
FIG. 4 is a perspective view showing a state where the UTP dielectric is accommodated in a UTP housing.
Figure 5:
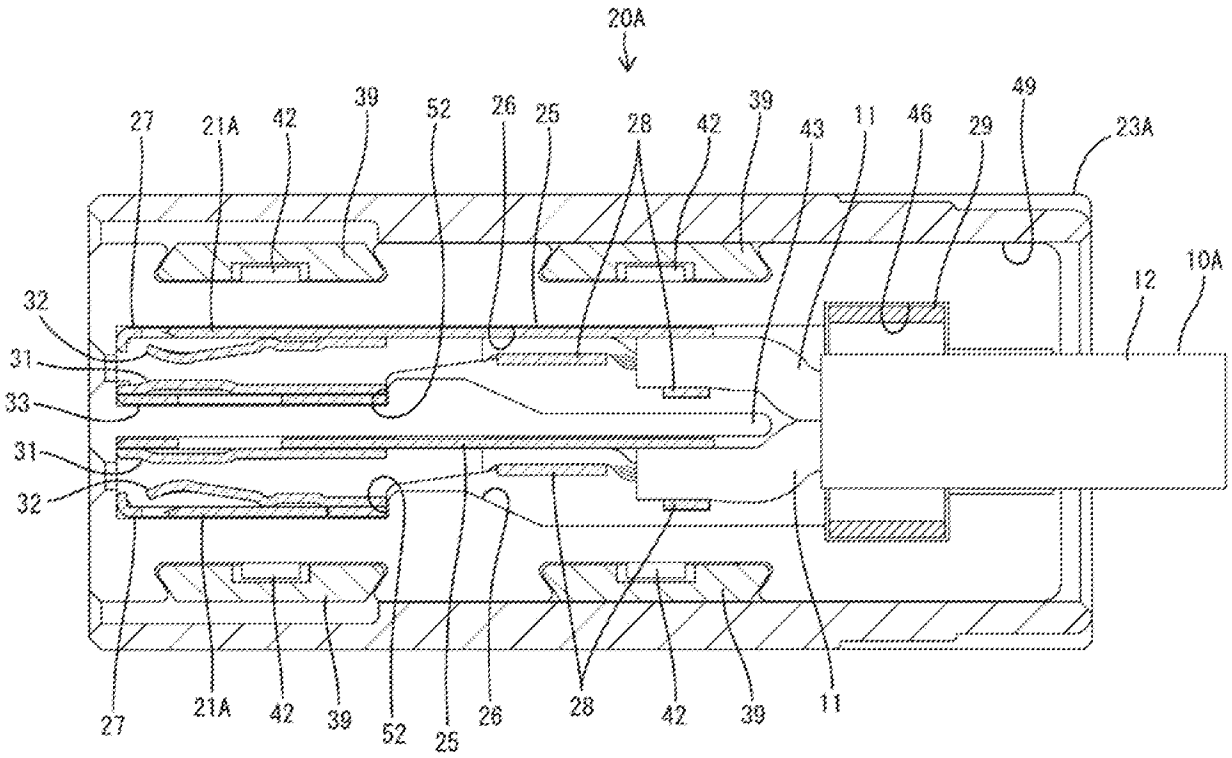
FIG. 5 is a section of the UTP dielectric and the UTP connection terminals accommodated in the UTP housing.
Figure 10:
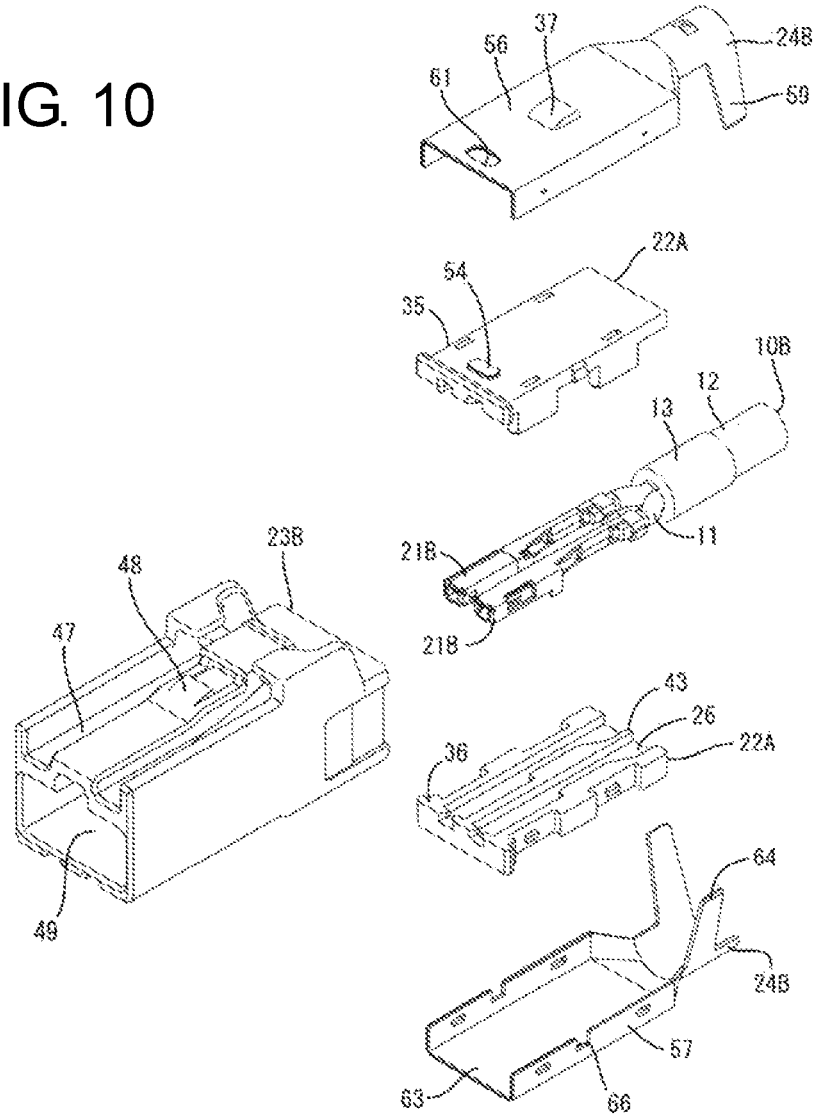
FIG. 10 is an exploded perspective view of an STP connector.
Figure 19:
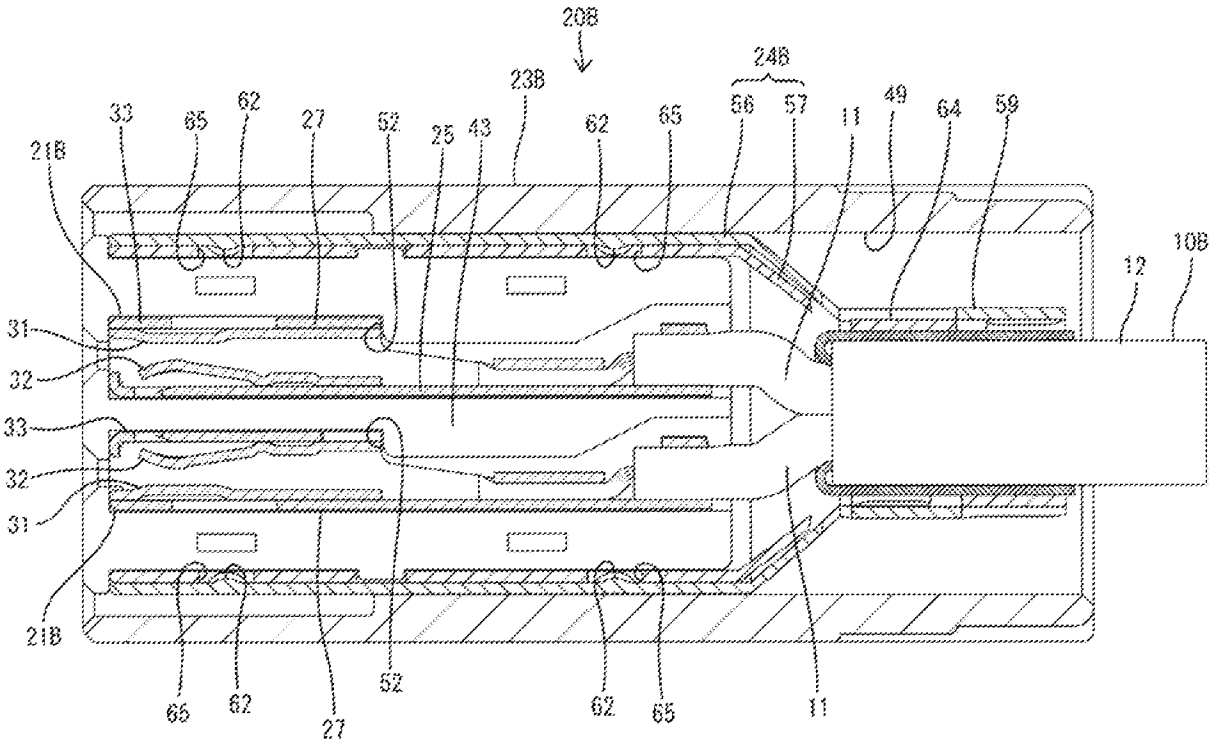
FIG. 19 is a section of the STP dielectric, the STP connection terminals and an outer conductor accommodated in the STP housing.
Figure 20:
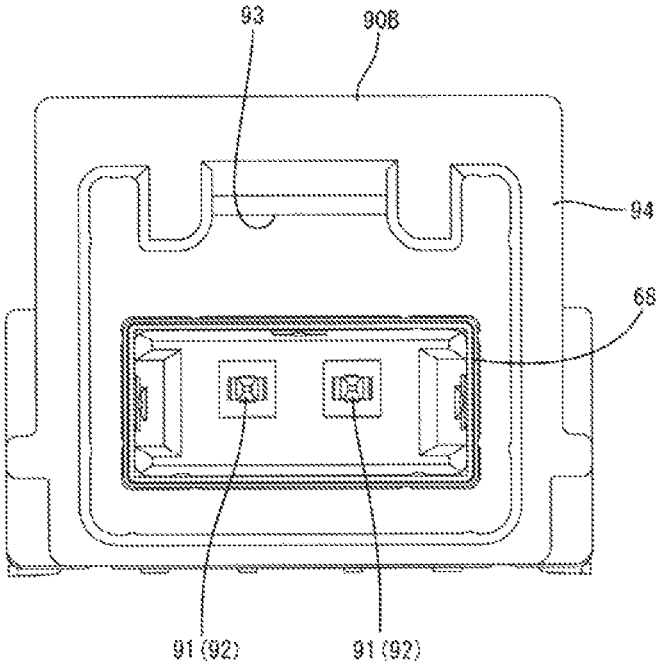
FIG. 20 is a front view of a mating STP connector.

One embodiment of the invention is described on the basis of the drawings. A connector structure of this embodiment is used in an in-vehicle communication network system and is composed of a UTP connector 20A provided on an end part of a UTP cable 10A, as shown in FIGS. 1, 4 and 5, and an STP connector 20B provided on an end part of an STP cable 10B, as shown in FIGS. 10 and 19. The UTP connector 20A and the STP connector 20B have structural parts common or approximate to each other, and the UTP cable 10A and the STP cable 10B can easily replace each other while impedance is adjusted.

Figure 8:
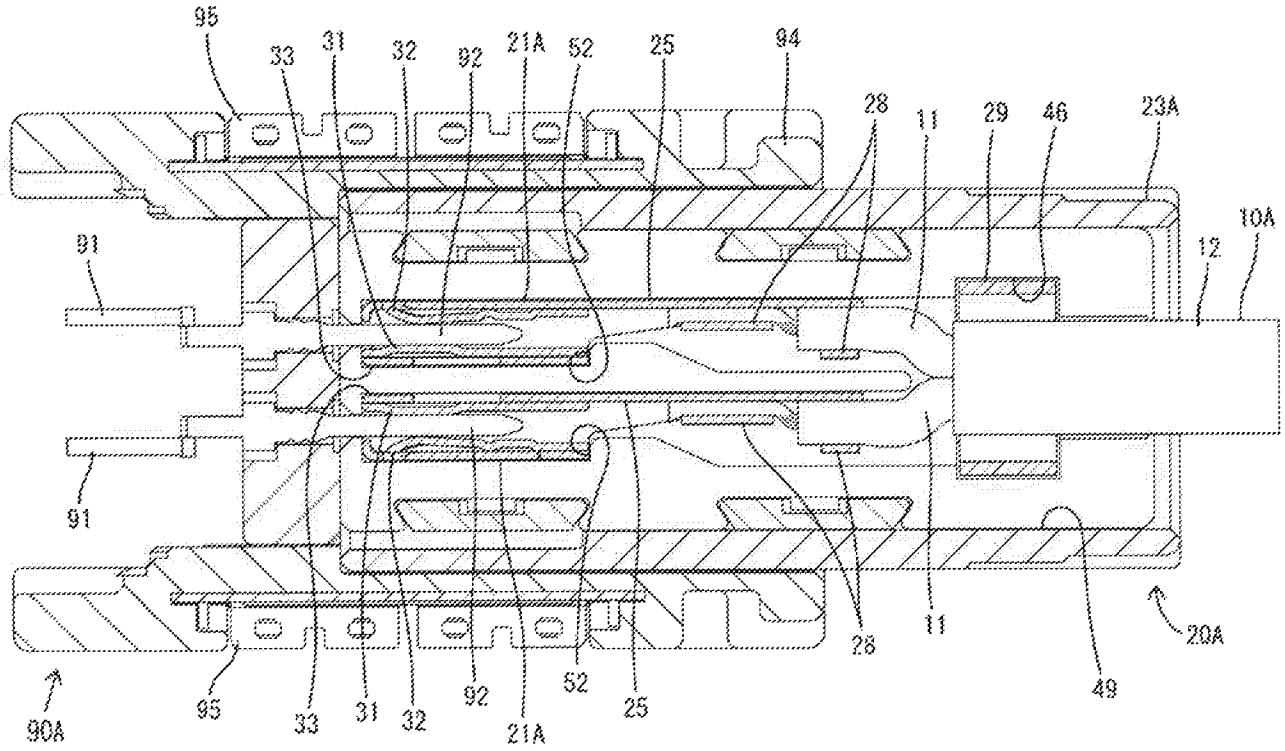
FIG. 8 is a section showing a state where the UTP connector and the mating UTP connector are connected to each other.
Figure 21:
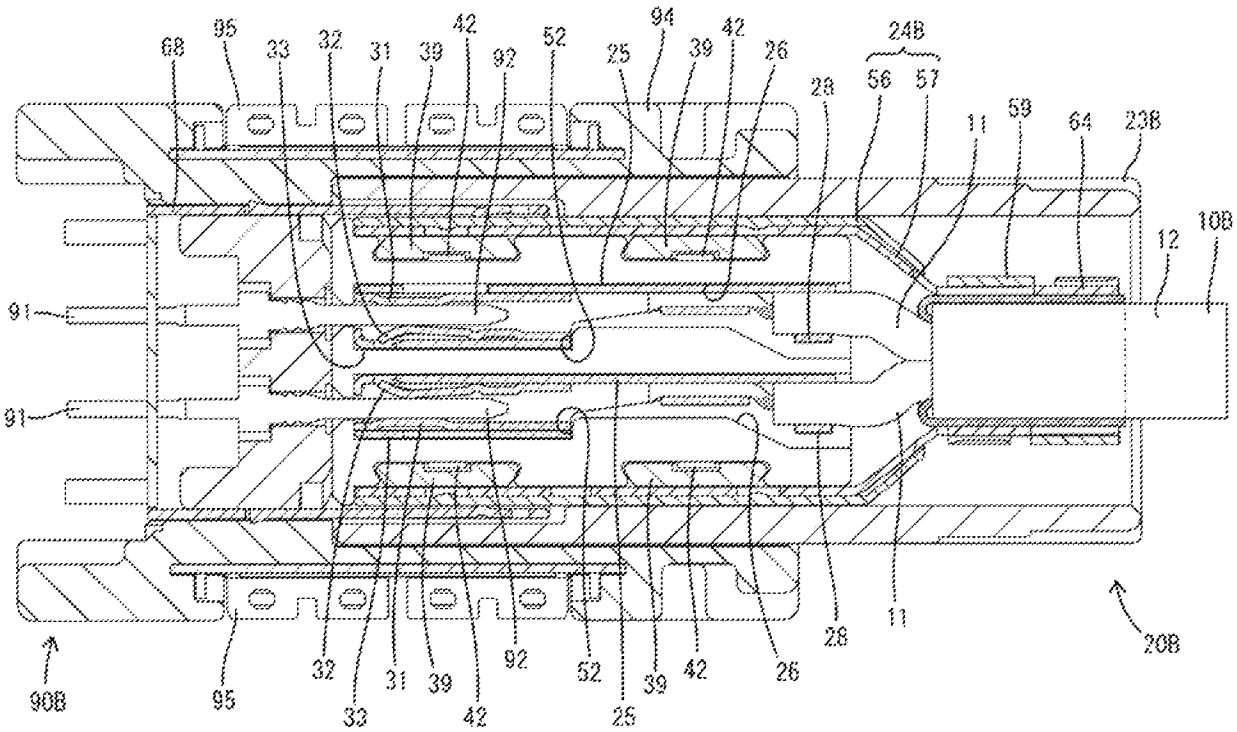
FIG. 21 is a section showing a state where the STP connector and the mating STP connector are connected to each other.

As shown in FIG. 8, the UTP connector 20A is connected to a mating UTP connector 90A and includes UTP connection terminals 21A, a UTP dielectric 22A and a UTP housing 23A. As shown in FIG. 21, the STP connector 20B is connected to a mating STP connector 90B and includes STP connection terminals 21B, an STP dielectric 22B, an outer conductor 24B and an STP housing 23B. Note that words "UTP" and "STP" in the terms of the above respective members are merely added for convenience to distinguish these.

UTP Cable

The UTP cable 10A is composed of a pair of twisted wires 11 and a sheath 12 surrounding the respective wires 11. The wire 11 is composed of a conductor and a coating surrounding the conductor. An end part of each wire 11 is exposed from the sheath 12 and connected to the UTP connection terminal 21A.

UTP Connection Terminal

The UTP connection terminals 21A to be connected to the respective wires 11 of the UTP cable 10A have substantially the same form except a different arrangement of some parts (resilient contact pieces 32 and receiving portions 31 to be described later). This UTP connection terminal 21A is connected to a male terminal 91 provided in the mating UTP connector 90A when the UTP connector 20A and the mating UTP connector 90A are connected. The UTP connection terminal 21A is formed integrally such as by bending a conductive metal plate material and is long and narrow in a front-rear direction (lateral direction of FIG. 5).

As shown in FIG. 5, the UTP connection terminal 21A includes a base plate 25 in the form of a strip extending along the front-rear direction. A box 27 substantially in the form of a rectangular tube is provided on a front part of the base plate 25, and an open barrel 28 is provided on a rear part of the base plate 25. The barrel 28 is connected electrically and mechanically to the conductor and the coating of the wire 11. Note that a crimp ring 29 separate from the UTP connection terminals 21A is crimped and connected to an end part of the sheath 12 of the UTP cable 10A. The crimp ring 29 includes parts protruding while being held in close contact on both widthwise sides by crimping.

The receiving portion 31 and the resilient contact piece 32 project to face each other in a width direction (direction perpendicular to an inserting direction of the male terminal 91 into the box 27, vertical direction of FIG. 5) inside the box 27.

In the UTP connection terminal 21A to be accommodated into one accommodating portion 26, the strip-like resilient contact piece 32 is provided on the base plate 25 and the receiving portion 31 having a trapezoidal cross-sectional shape is provided on a ceiling plate 33 opposite to the base plate 25. In contrast, in the UTP connection terminal 21A to be accommodated into the other accommodating portion 26 to be described later, the receiving portion 31 is provided on the base plate 25 and the resilient contact piece 32 is provided on the ceiling plate 33. The resilient contact piece 32 is cantilevered forward from a rear end of the ceiling plate 33 and is deflectable and deformable with the rear end of the ceiling plate 33 as a support.

Figure 9:
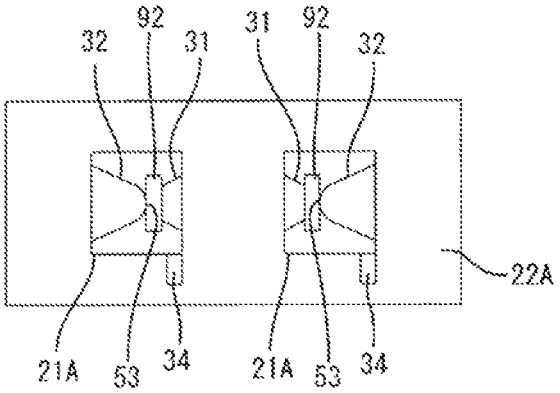
FIG. 9 is a diagram of a mode shown in FIGS. 1 to 8.

The resilient contact piece 32 projects farther into the box 27 than the receiving portion 31. When the UTP connection terminal 21A is connected to the male terminal 91, a later-described tab 92 of the male terminal 91 is inserted into the box 27, and the inserted tab 92 is resiliently sandwiched between the receiving portion 31 and the resilient contact piece 32, as schematically shown in FIG. 9. As just described, an insertion area 53 for the male terminal 91 is provided between the receiving portion 31 and the resilient contact piece 32 in the box 27. Further, the UTP connection terminal 21A includes a protrusion 34 projecting out (in a direction along a plane direction of the ceiling plate 33; down in a state accommodated in the accommodating portion 26) from one end side of the ceiling plate 33.

UTP Dielectric

Figure 3:
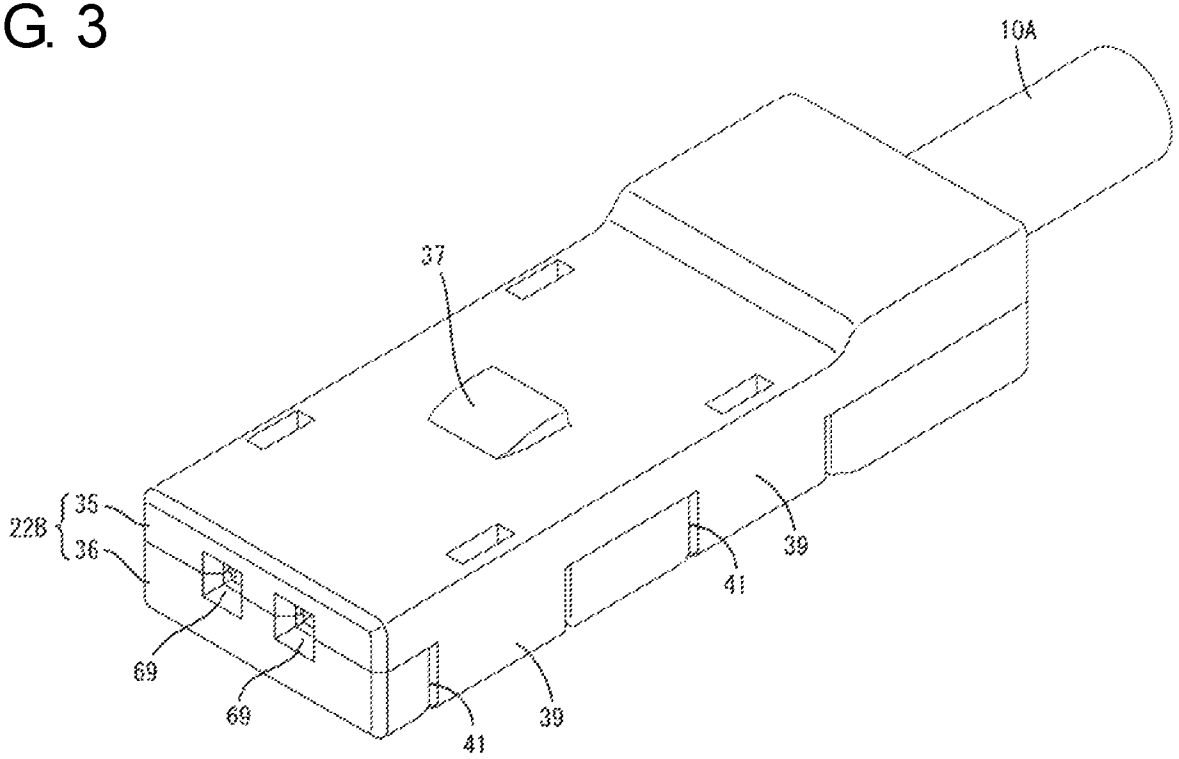
FIG. 3 is a perspective view showing a state where the UTP connection terminals are covered by an upper dielectric of the UTP dielectric.

The UTP dielectric 22A is made of synthetic resin and, as shown in FIGS. 1 and 3, composed of an upper dielectric 35 and a lower dielectric 36 that are vertically dividable. The upper dielectric 35 is a plate substantially rectangular in a plan view and includes a lock projection 37 in a widthwise central part of an upper surface. The lock projection 37 is lockable to the UTP housing 23A. Recesses 38 are provided in the lower surface of the upper dielectric 35 (see FIG. 6 and FIG. 12 although the STP dielectric 22B is shown) for positioning upper parts of the respective UTP connection terminals 21A in parallel and positioning an upper part of the crimp ring 29. Front and rear mounting pieces 39 project down on each of both widthwise end parts of the upper dielectric 35.

The lower dielectric 36 is a plate substantially rectangular in a plan view and includes front and rear mounting receiving portions 41 in the form of rectangular recesses on each of both widthwise end parts and mounting projections 42 on the back surfaces of the mounting receiving portions 41. The mounting pieces 39 are fit into the respective mounting receiving portions 41 and tips of the mounting pieces 39 are hooked to lock the mounting projections 42. Thus, the lower dielectric 36 and the upper dielectric 35 are held united across the UTP connection terminals 21A.

The accommodating portions 26 for positioning and holding lower parts of the respective UTP connection terminals 21A in parallel are provided at positions facing the recesses 38 of the upper dielectric 35 in the upper surface of the lower dielectric 36. The accommodating portion 26 has a cross-sectional shape corresponding to the outer shape of the UTP connection terminal 21A, and two of the accommodating portions 26 are provided on both widthwise sides across a thin separation wall 43 to correspond to the respective UTP connection terminals 21A. Further, tab insertion holes 69 are open in the front surface of the UTP dielectric 22A when the upper and lower dielectrics 35, 36 are united. The tab insertion holes 69 communicate with the accommodating portions 26 and the recesses 38 and receive the tabs 92.

The upper accommodating portion 26 in FIG. 5 includes a recess 44 (see FIG. 11 although the STP dielectric 22B is shown) having a rectangular cross-sectional shape at a position of a back bottom surface near the separation wall 43, and the other accommodating portion 26 includes a recess (see FIG. 11) that similarly has a rectangular cross-sectional shape at a position of a back bottom surface near a widthwise outer side wall located on a side opposite to the separation wall 43. Steps 52 are provided on the separation wall 43 and the widthwise outer side wall. The steps 52 are adjacent to the recesses 44 and receive the rear ends of the ceiling plats 33 of the boxes 27 of the UTP connection terminals 21A. As shown in FIG. 5, the UTP connection terminal 21A accommodated in the one accommodating portion 26 is arranged such that the base plate 25 extends in the front-rear direction along a side surface of the widthwise outer wall (side surface of the widthwise outer side wall including no step portion 52), and the UTP connection terminal 21A accommodated in the other accommodating portion 26 is arranged such that the base plate 25 extends in the front-rear direction along the separation wall 43 (side surface of the separation wall 43 including no step 52). Further, a recess 46 continuous rearward from the accommodating portions 26 is provided in the lower surface of the lower dielectric 36 for positioning and holding a lower part of the crimp ring 29.

UTP Housing

Figure 6:
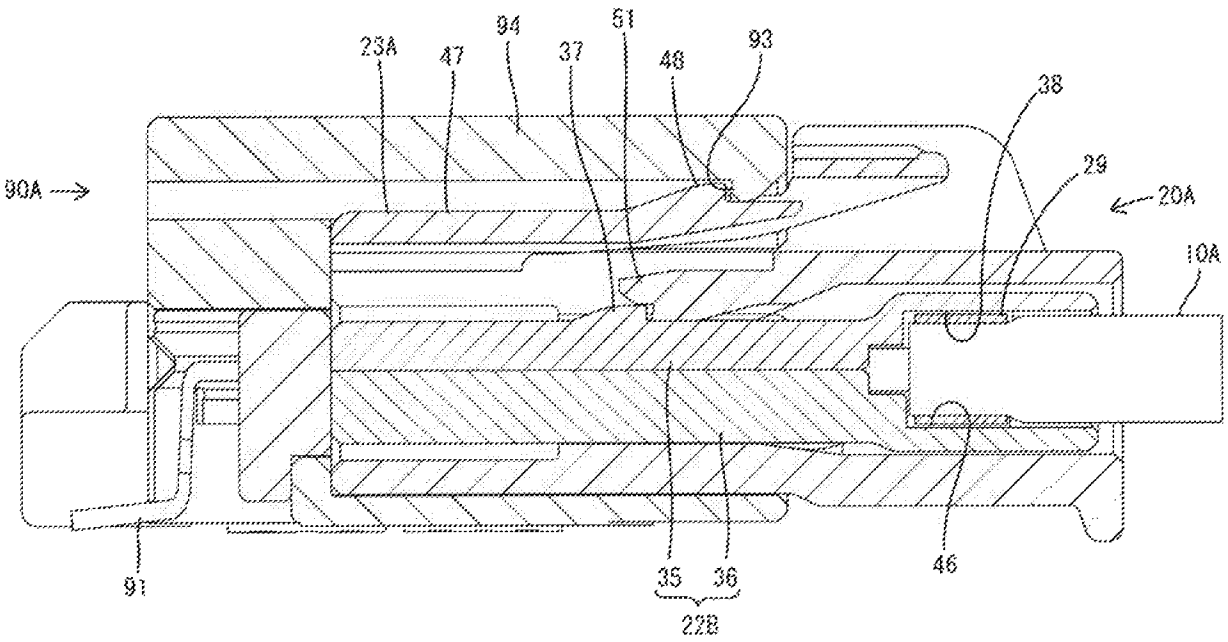
FIG. 6 is a section showing a locking structure of the UTP dielectric accommodated in the UTP housing and a locking structure for a mating UTP connector.

The UTP housing 23A is made of synthetic resin and includes, as shown in FIG. 4, a housing body 47 substantially in the form of a rectangular tube. A lock arm 48 projects in a widthwise central part of the upper surface of the housing body 47. The lock arm 48 is cantilevered rearward from a front part of the upper surface of the housing body 47, and holds the UTP connector 20A and the mating UTP connector 90A in a connected state by resiliently locking a lock receiving portion 93 of the mating UTP connector 90A. The inside of the housing body 47 is open in the front-rear direction as an insertion portion 49. The insertion portion 49 has a cross-sectional shape corresponding to the outer shape of the UTP dielectric 22A, and the UTP dielectric 22A can fit therein. As shown in FIG. 6, a deflectable and deformable locking lance 51 is cantilevered forward on the upper surface of the inner wall of the insertion portion 49. The UTP dielectric 22A is inserted into the insertion portion 49 from behind, and the locking lance 51 is deflected and deformed by the lock projection 37 but returns to lock the lock projection 37 to hold the UTP dielectric 22A in the UTP housing 23A.

Mating UTP Connector

Figure 7:
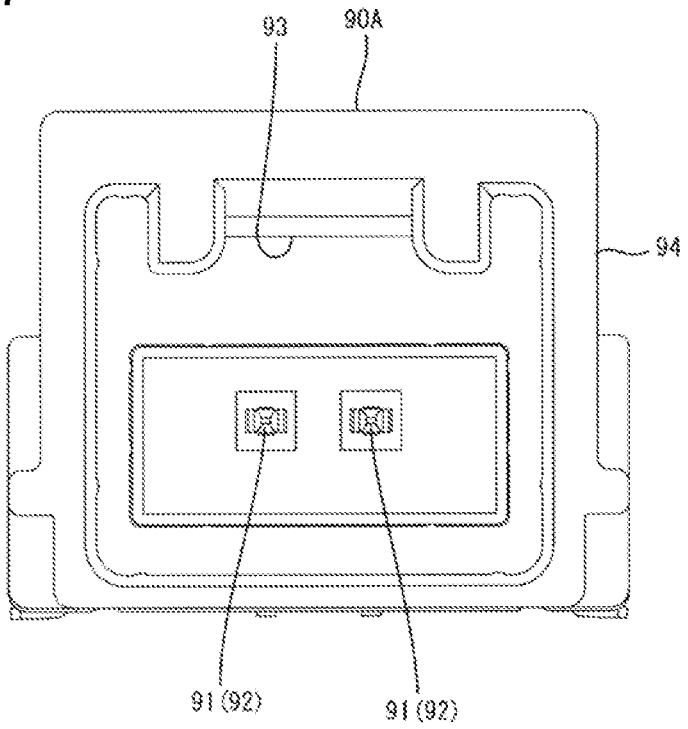
FIG. 7 is a front view of the mating UTP connector.

The mating UTP connector 90A includes a receptacle 94 made of synthetic resin. The receptacle 94 is supported on an unillustrated circuit board and the UTP housing 23A can fit therein. As shown in FIGS. 6 and 7, the lock receiving portion 93 to be locked by the lock arm 48 projects on the inner surface of the upper wall of the receptacle 94.

As shown in FIG. 8, pegs 95 made of a metal plate material are mounted on the outer surfaces of both side walls of the receptacle 94. The pegs 95 are soldered to a surface of the circuit board to fix the mating UTP connector 90A to the circuit board.

The male terminals 91 paired in the width direction are mounted in the receptacle 94. Each male terminal 91 is a rectangular wire or pin and includes a bent part at an intermediate position in a length direction. Each male terminal 91 includes the tab 92 projecting into the receptacle 94. The tabs 92 of the respective male terminals 91 have a flat cross-sectional shape in the width direction and are arranged in parallel while having a separation distance in the width direction corresponding to that between the respective UTP connection terminals 21A. Further, the male terminal 91 includes a part projecting out, and this part is mounted on, soldered and connected to the surface of the unillustrated circuit board.

STP Cable

The STP cable 10B is composed of a pair of twisted wires 11, a shield conductor 13 such as a braided wire for surrounding and shielding the respective wires 11, and a sheath 12 surrounding the shield conductor 13. An end part of each wire 11 and an end part of the shield conductor 13 are exposed from the sheath 12. The end part of the shield conductor 13 is folded and put on an outer peripheral side of the sheath 12. The end part of each wire 11 is connected to the STP connection terminal 21B.

STP Connection Terminal

The STP connection terminals 21B to be connected to the respective wires 11 of the STP cable 10B have the same shape. As shown in FIG. 21, the STP connection terminal 21B is connected to a male terminal 91 provided in the mating STP connector 90B when the STP connector 20B and the mating STP connector 90B are connected. The STP connection terminal 21B is formed integrally such as by bending a conductive metal plate material and is long and narrow in the front-rear direction.

This STP connection terminal 21B has substantially the same configuration as the UTP connection terminal 21A and includes a base plate 25, a box 27 and a barrel 28. The box 27 and the barrel 28 of the STP connection terminal 21B have substantially the same shapes as the box 27 and the barrel 28 of the UTP connection terminal 21A.

The STP connection terminal 21B to be accommodated in the upper accommodating portion 26 in FIG. 21 has a receiving portion 31 provided on the base plate 25 and a resilient contact piece 32 provided on a ceiling plate 33 in. In contrast, the STP connection terminal 21B to be accommodated in the lower accommodating portion 26 in FIG. 21 has a resilient contact piece 32 provided on the base plate 25 and a receiving portion 31 provided on a ceiling plate 33. As just described, a positional relationship of the resilient contact piece 32 and the receiving portion 31 is reversed between the STP connection terminal 21B and the UTP connection terminal 21A. The shapes of the respective resilient contact piece 32 and receiving portion 31 are the same as in the case of the UTP connection terminal 21A. Further, the STP connection terminal 21B includes a protrusion 34 projecting out from one end of the ceiling plate 33 as in the UTP connection terminal 21A.

STP Dielectric

Figure 16:
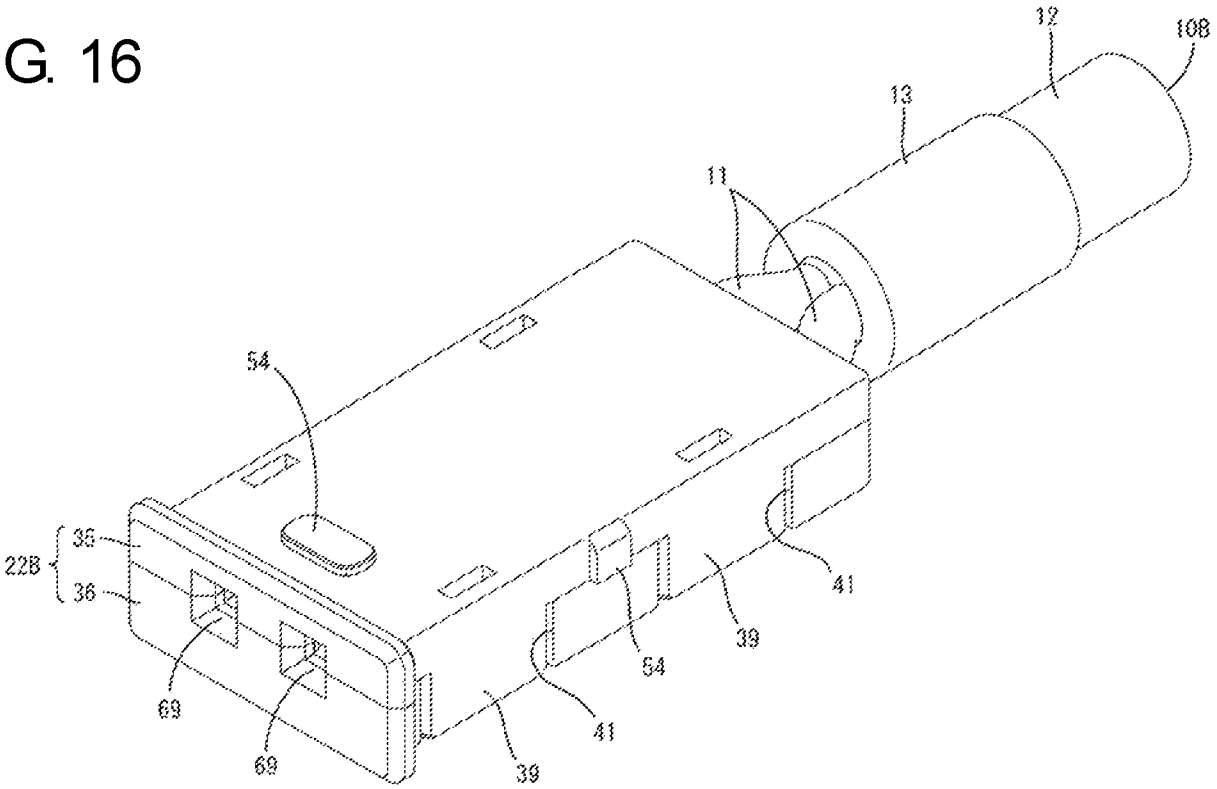
FIG. 16 is a perspective view showing a state where the STP connection terminals are covered by the upper dielectric of the STP dielectric.

The STP dielectric 22B is made of synthetic resin and, as shown in FIGS. 10 and 16, is composed of an upper dielectric 35 and a lower dielectric 36 that are vertically dividable. The upper dielectric 35 is a plate substantially rectangular in a plan view and includes positioning protrusions 54 for the outer conductor 24B on an upper surface and both side surfaces. Similarly to the upper dielectric 35 of the UTP dielectric 22A, mounting pieces 39 are provided on both widthwise end parts of the upper dielectric 35. The lower dielectric 36 also is provided with mounting receiving portions 41 and mounting projections 42 similar to the lower dielectric 36 of the UTP dielectric 22A. The lower and upper dielectrics 36, 35 are held united across the STP connection terminals 21B by the locking of the mounting pieces 39 and the mounting projections 42.

The STP connector 20B has no crimp ring 29 and a part corresponding to the recess 46 for receiving the crimp ring 29 is not necessary in rear parts of the upper and lower dielectrics 35, 36. Thus, dimensions of the upper and lower dielectrics 35, 36 in the front-rear direction are shorter than that of the UTP dielectric 22A by that much.

Figure 11:
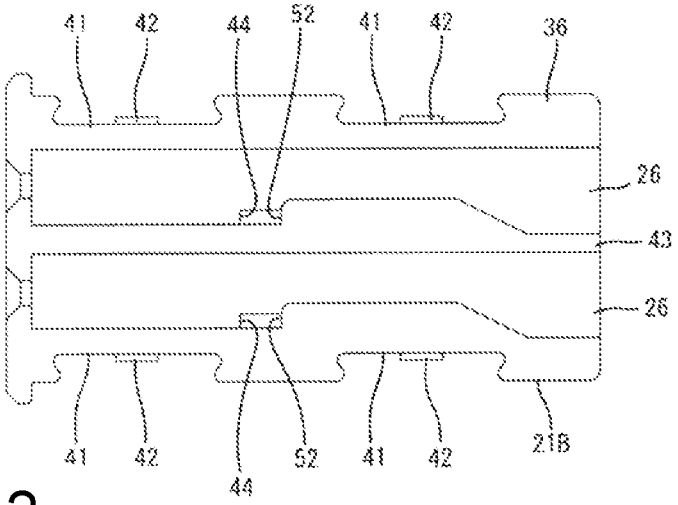
FIG. 11 is a plan view of a lower dielectric of an STP dielectric.
Figure 12:
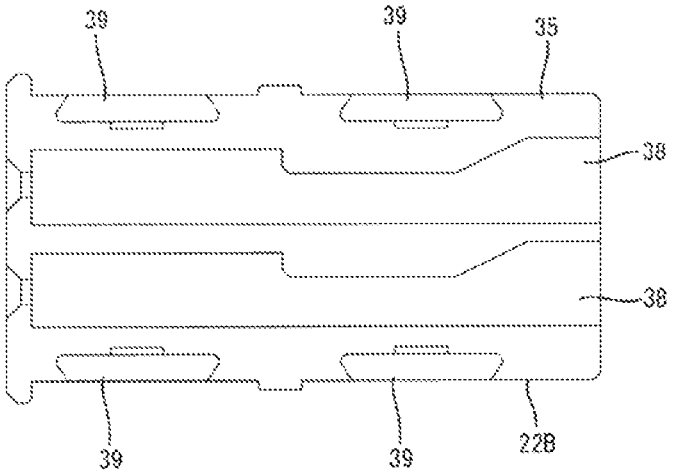
FIG. 12 is a bottom view of an upper dielectric of the STP dielectric.

Recesses 38 for positioning upper parts of the respective STP connection terminals 21B in parallel are provided in the lower surface of the upper dielectric 35, as shown in FIG. 12. Additionally, accommodating portions 26 for positioning and holding the lower parts of the respective STP connection terminals 21B in parallel are provided at positions facing the recesses 38 in the upper surface of the lower dielectric 36, as shown in FIG. 11.

The accommodating portion 26 has a cross-sectional shape corresponding to the outer shape of the STP connection terminal 21B, and two of the accommodating portions 26 are provided on both widthwise sides across a separation wall 43 to correspond to the respective STP connection terminals 21B. A thickness (dimension in the width direction) of the separation wall 43 of the STP dielectric 22B is larger than that of the separation wall 43 of the UTP dielectric 22A. That is, a separation distance in the width direction (hereinafter, referred to as a pitch width) of the respective accommodating portions 26 of the STP dielectric 22B is longer than that of the respective accommodating portions 26 of the UTP dielectric 22A. Further, tab insertion holes 69 are open in the front surface of the STP dielectric 22B when the upper and lower dielectrics 35, 36 are united. The tab insertion holes 69 communicate with the accommodating portions 26 and the recesses 38 and receive the tabs 92.

The upper accommodating portion 26 in FIG. 11 includes a recess 44 having a rectangular cross-sectional shape at a position of a back bottom surface near the separation wall 43, and the other accommodating portion 26 similarly includes a recess 44 having a rectangular cross-sectional shape at a position of a back bottom surface near a widthwise outer side wall (widthwise outer side wall located on a side opposite to the separation wall 43). Steps 52 are provided on the separation wall 43 and the widthwise outer side wall adjacent to the recesses 44. The rear ends of the ceiling plates 33 of the boxes 27 of the STP connection terminals 21B are fit in the steps 52. The STP connection terminal 21B accommodated in the one accommodating portion 26 is arranged such that the base plate 25 extends in the front-rear direction along a side surface of the widthwise outer side wall (side surface of the widthwise outer side wall with no step 52), and the STP connection terminal 21B accommodated in the other accommodating portion 26 is arranged such that the base plate 25 extends in the front-rear direction along the separation wall 43 (side surface of the separation wall 43 including no step 52). The form of each accommodating portion 26 is the same as in the case of the UTP connection terminals 21A.

Outer Conductor

Figure 14:
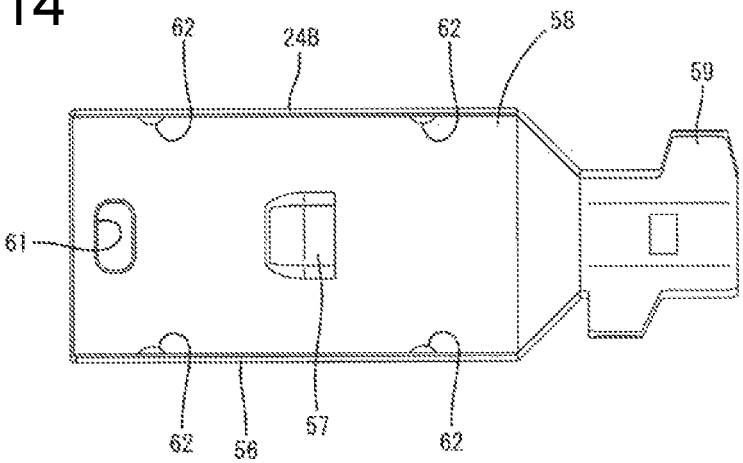
FIG. 14 is a bottom view of an upper outer conductor.
Figure 18:
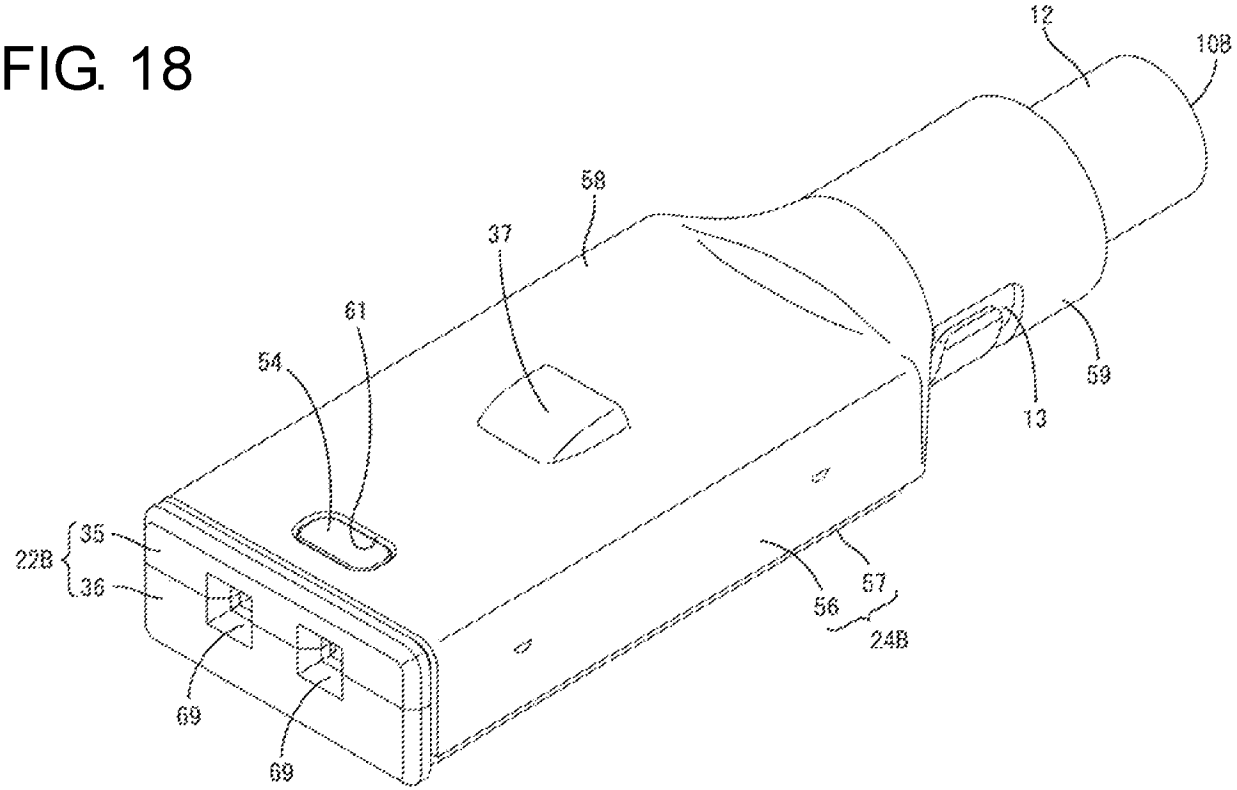
FIG. 18 is a perspective view showing a state where the upper outer conductor covers an upper part of the STP dielectric.

The outer conductor 24B is made of conductive metal and, as shown in FIGS. 10 and 18, is composed of an upper outer conductor 56 and a lower outer conductor 57 that are vertically dividable. As shown in FIG. 14, the upper outer conductor 56 includes an upper shell 58 substantially rectangular in a plan view and an open upper barrel 59 connected to and behind the upper shell portion 58. The upper shell 58 is arranged to cover the upper dielectric 35 from above. A flat plate of the upper shell 58 includes a lock projection 37 in a widthwise central part of an upper surface and an upper positioning hole 61 in front of the lock projection 37. Further, the upper shell 58 includes side plates hanging down from both widthwise ends of the flat plate, and front and rear holding projections 62 on the inner surface of each of the side plates. The upper barrel 59 includes a projecting piece displaced in the front-rear direction from both widthwise side edges and projects down.

Figure 13:
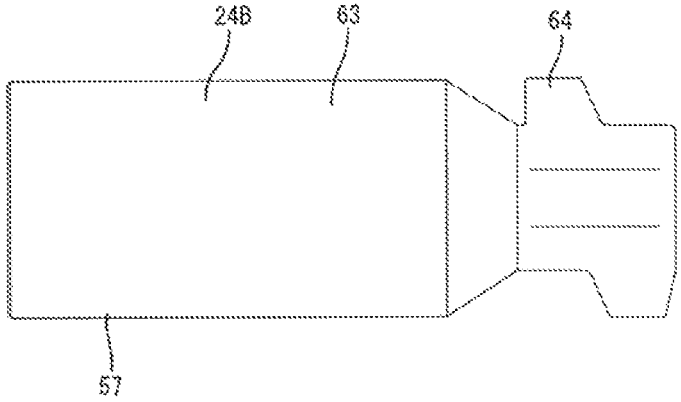
FIG. 13 is a bottom view of a lower outer conductor.
Figure 17:
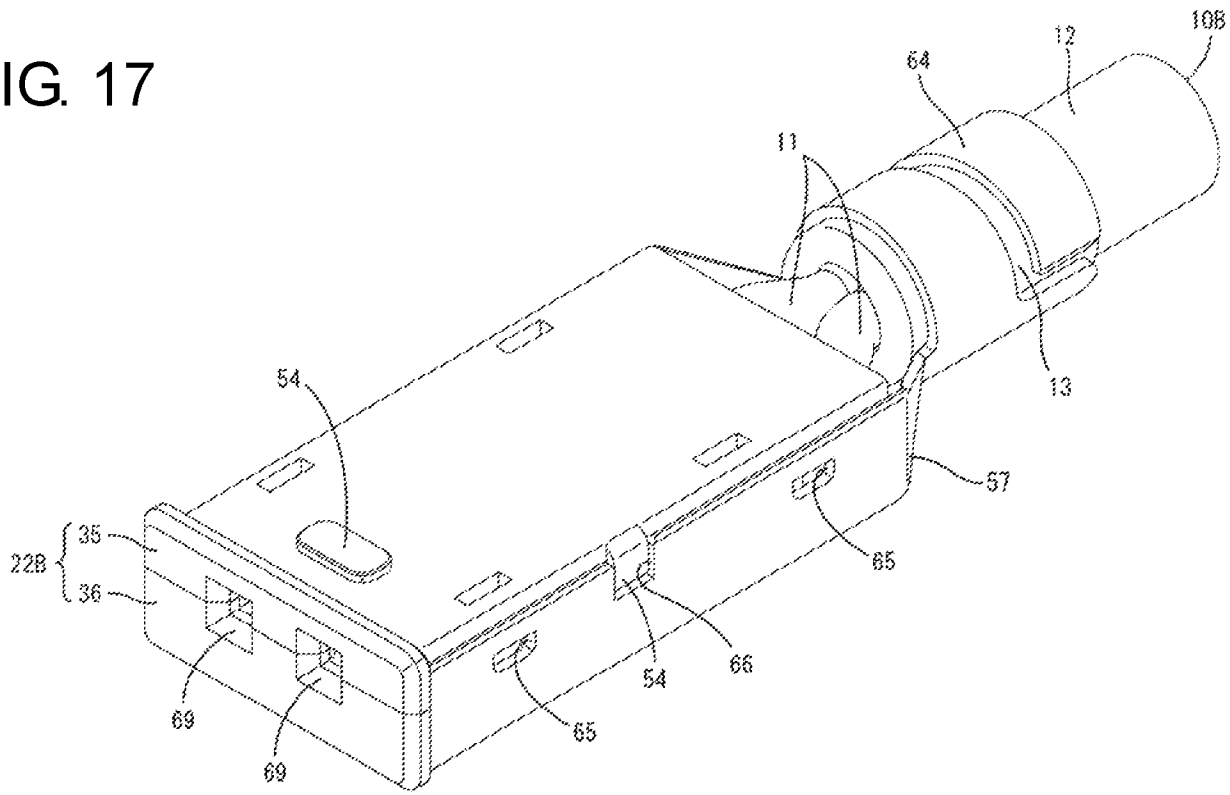
FIG. 17 is a perspective view showing a state where the lower outer conductor covers a lower part of the STP dielectric.

As shown in FIG. 13, the lower outer conductor 57 includes a lower shell portion 63 substantially rectangular in a plan view and an open lower barrel 64 connected to and behind the lower shell 63. As shown in FIG. 17, the lower shell 63 covers the lower dielectric 36 from below. The lower shell 63 includes side plates rising from both widthwise ends of a flat plate and front and rear holding holes 65 in each of the side plates. Further, lower positioning holes 66 are open in the upper ends of central parts of the side plates of the lower shell 63 in the front-rear direction. The lower barrel 64 includes a projecting piece displaced in the front-rear direction from both widthwise end edges and projecting up.

When the upper and lower outer conductors 56, 57 are united while enclosing the STP dielectric 22B, the side plates of the upper shell 58 cover those of the lower shell 63 from outside and, as shown in FIG. 19, the respective holding projections 62 are inserted and locked into the holding holes 65. Further, front and rear projecting pieces of each of the upper and lower barrels 59, 64 are arranged alternately.

[STP Housing]

The STP housing 23B is made of synthetic resin and includes a substantially rectangular tubular housing body 47. The STP housing 23B has substantially the same shape as the UTP housing 23A and includes a lock arm 48, an insertion portion 49 and a locking lance 51 having the same forms (shapes and arrangement) of those of the UTP housing 23A. Of course, a locking partner of the locking lance 51 is not the STP dielectric 22B, but the lock projection 37 of the upper outer conductor 56.

Mating STP Connector

The mating STP connector 90B includes a receptacle 94 made of synthetic resin. The mating STP connector 90B has substantially the same configuration as the mating UTP connector 90A and includes the receptacle 94, a lock receiving portion 93, pegs 95 and a pair of male terminals 91. A pitch width of the respective male terminals 91 of the mating STP connector 90B is longer than that of the male terminals 91 of the mating UTP connector 90A.

Assembling of UTP Connector

Figure 2:
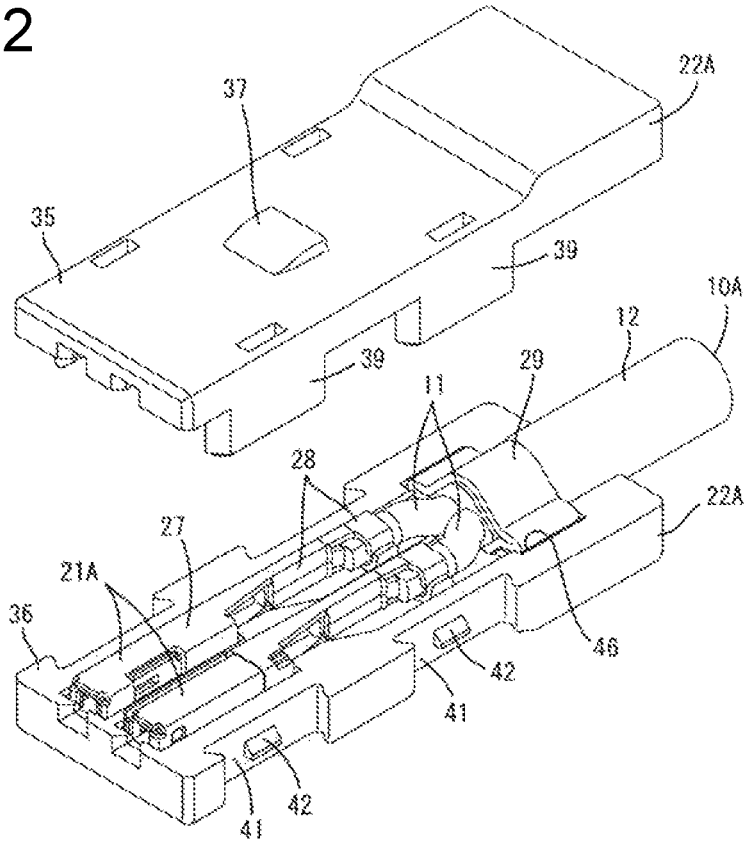
FIG. 2 is a perspective view showing a state where UTP connection terminals are accommodated in accommodating portions of a UTP dielectric.

In assembling the UTP connector 20A, the barrels 28 of the UTP connection terminals 21A first are connected to the end parts of the respective wires 11 of the UTP cable 10A by crimping. Subsequently, as shown in FIG. 2, the respective UTP connection terminals 21A are positioned and inserted into the accommodating portions 26 of the lower dielectric 36 from above, and the crimp ring 29 fit to the UTP cable 10A is positioned and inserted into the recess 46 of the lower dielectric 36. Subsequently, as shown in FIG. 3, the upper dielectric 35 is put on the lower dielectric 36 from above. The mounting pieces 39 resiliently lock the mounting projections 42 to hold the upper and lower dielectrics 35, 36 (UTP dielectric 22A) united. The respective UTP connection terminals 21A are arranged in parallel to each other in the UTP dielectric 22A with the base plates 25 thereof located on one widthwise side (upper side in FIG. 5).

Subsequently, the UTP dielectric 22A is inserted into the insertion portion 49 of the UTP housing 23A from behind. When the UTP dielectric 22A is inserted properly into the insertion portion 49, the locking lance 51 resiliently locks the lock projection 37 of the UTP dielectric 22A to hold the UTP dielectric 22A in the UTP housing 23A (see FIG. 6).

Assembling of STP Connector

Figure 15:
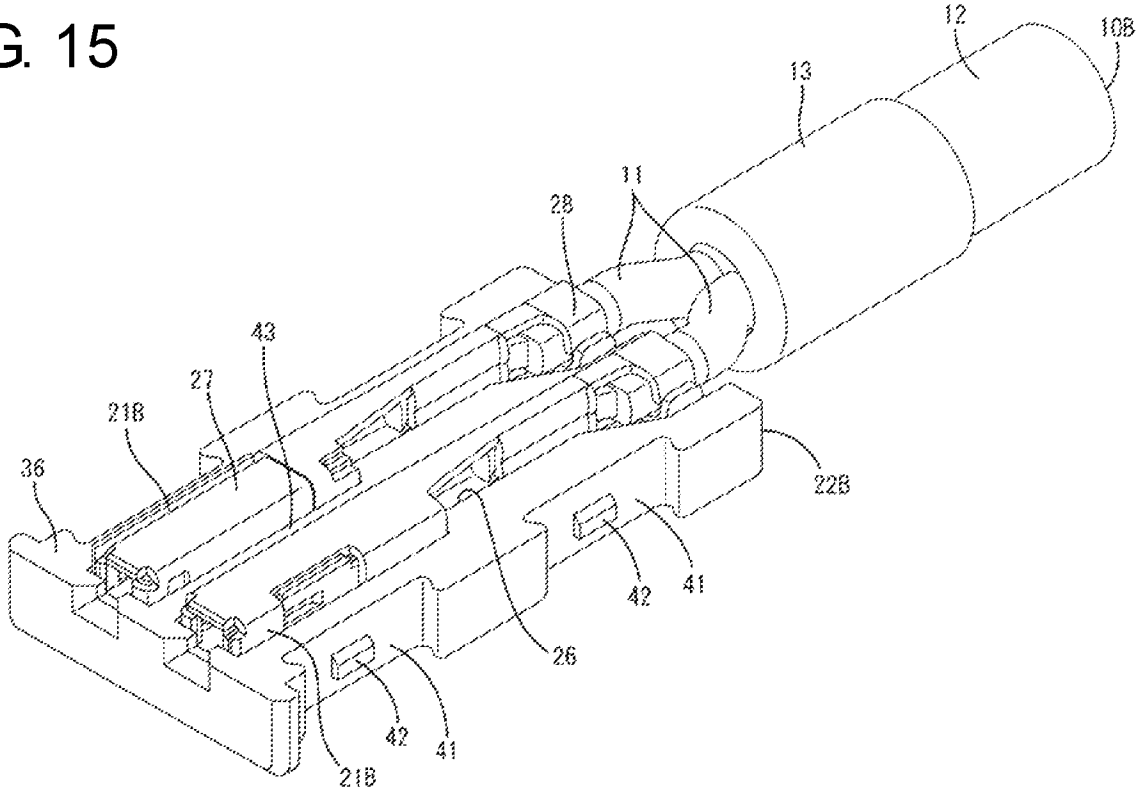
FIG. 15 is a perspective view showing a state where STP connection terminals are accommodated in accommodating portions of the STP dielectric.

Also in assembling the STP connector 20B, the barrels 28 of the STP connection terminals 21B first are connected to the end parts of the respective wires 11 of the STP cable 10B by crimping. Then, after the respective STP connection terminals 21B are positioned in the accommodating portions 26 of the lower dielectric 36 from above, as shown in FIG. 15, the upper dielectric 35 is put on the lower dielectric 36, as shown in FIG. 16, and the upper and lower dielectrics 35, 36 (STP dielectric 22B) are held united by the locking of the mounting pieces 39 and the mounting projections 42. The respective STP connection terminals 21B are parallel to each other in the STP dielectric 22B with the base plates 25 thereof held on one widthwise side (upper side in FIG. 21). A pitch width of the respective STP connection terminals 21B in the STP dielectric 22B is larger than that of the respective UTP connection terminals 21A in the UTP dielectric 22A due to the thicker separation wall 43.

Subsequently, as shown in FIG. 17, the STP dielectric 22B is placed on the lower shell 63 of the lower outer conductor 57. The positioning protrusions 54 disposed on the side surfaces of the upper dielectric 35 are aligned with and fit into the lower positioning holes 66 of the lower shell 63 to position the lower outer conductor 57 with respect to the STP dielectric 22B in the front-rear direction. At this time, the lower barrel 64 is arranged to face the shield conductor 13 exposed on the outer peripheral side of the STP cable 10B from below. In that state, the lower barrel 64 is connected to the shield conductor 13 of the STP cable 10B by crimping.

Subsequently, as shown in FIG. 18, the upper outer conductor 56 is put on the lower outer conductor 57 to cover the STP dielectric 22B from above. The upper and lower outer conductors 56, 57 (outer conductor 24B) are held in a division restricted state by the locking of the holding projections 62 and the holding holes 65. Further, the positioning protrusion 54 disposed on the upper surface of the upper dielectric 35 is aligned with and fit into the upper positioning hole 61 of the upper shell 58 to position the upper outer conductor 56 with respect to the STP dielectric 22B in the front-rear direction. Then, the upper barrel 59 is arranged to face the shield conductor 13 of the STP cable 10B from above. In that state, the upper barrel 59 is connected to the shield conductor 13 of the STP cable 10B by crimping. In this way, the shield conductor 13 is connected to the outer conductor 24B and the STP connection terminals 21B are surrounded by the outer conductor 24B via the STP dielectric 22B.

Thereafter, the outer conductor 24B in the united state enclosing the respective STP connection terminals 21B and the STP dielectric 22B is inserted into the insertion portion 49 of the STP housing 23B from behind. When the outer conductor 24B is inserted properly into the insertion portion 49, the locking lance 51 resiliently locks the lock projection 37 of the outer conductor 24B and the outer conductor 24B is retained and held in the STP housing 23B (see FIG. 22).

Connector Connection

When the UTP connector 20A is connected properly to the mating UTP connector 90A, as shown in FIG. 6, the lock arm 48 resiliently locks the lock receiving portion 93 and the connectors 20A, 90A are held in a separation restricted state. At this time, the tabs 92 of the respective male terminals 91 are inserted in and connected to the insertion areas 53 in the boxes 27 of the respective UTP connection terminals 21A. In this way, the tabs 92 of the respective male terminals 91 are arranged close to each other in the width direction.

Figure 22:
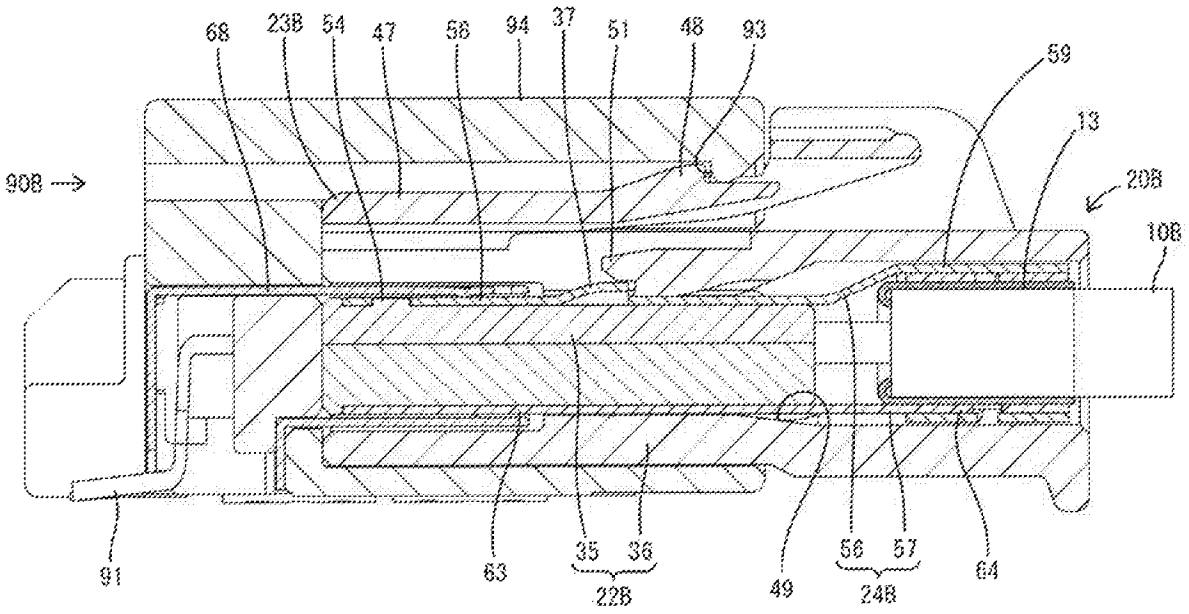
FIG. 22 is a section showing a locking structure of the STP dielectric housed in the STP housing and a locking structure for the mating STP connector.

Similarly, when the STP connector 20B is connected properly to the mating STP connector 90B, as shown in FIG. 22, the lock arm 48 resiliently locks the lock receiving portion 93, the connectors 20B, 90B are held in a separation restricted state and the tabs 92 of the respective male terminals 91 are inserted in and connected to the insertion areas 53 in the boxes 27 of the respective STP connection terminals 21B. The tabs 92 of the respective male terminals 91 are arranged farther apart in the width direction than in the case of the UTP connector 20A. Further, the outer conductor 24B is connected to a ground plate 68 disposed in the receptacle 94.

Functions and Effects

In the case of the UTP connector 20A, impedance is smaller by arranging the tabs 92 of the male terminals 91 closer to each other in the width direction than in the case of the STP connector 20B (see FIG. 9). On the other hand, in the case of the STP connector 20B, impedance is larger by arranging the tabs 92 of the male terminals 91 farther apart in the width direction than in the case of the UTP connector 20A (see FIG. 23). Further, the impedance can be reduced by arranging the respective UTP connection terminals 21A closer to each other than the respective STP connection terminals 21B in a state accommodated in the accommodating portions 26 paired in the width direction, and the impedance can be increased by arranging the respective STP connection terminals 21B farther apart than the respective UTP connection terminals 21A in a state accommodated in the accommodating portions 26 paired in the width direction.

As described above, the UTP connector 20A and the STP connector 20B have a substantially common configuration and there is no large structural difference between their configurations except that the STP connector 20B includes the outer conductor 24B. Thus, in replacing the UTP cable 10A by the STP cable 10B or replacing the STP cable 10B by the UTP cable 10A, the connector structure need not be changed significantly and cost can be reduced.

Further, the UTP connection terminals 21A and the STP connection terminals 21B are accommodated into the corresponding accommodating portions 26 with the protrusions 34 facing down, and mounted in the same direction. Thus, improper orientation in a mounting operation can be avoided and work efficiency can be improved.

Figure 23:
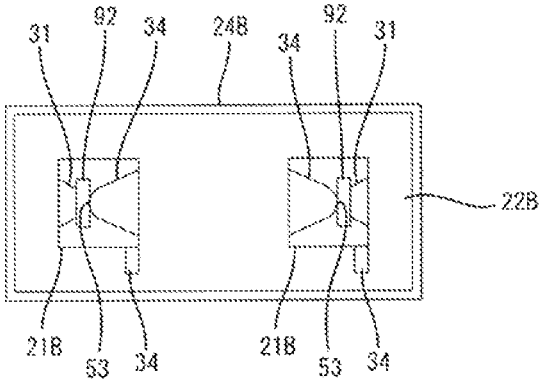
FIG. 23 is a diagram of a mode shown in FIGS. 10 to 22.

Furthermore, the impedance is decreased by locating the resilient contact pieces 32 on widthwise outer sides and locating the receiving portions 31 on widthwise inner side in the accommodating portions 26 paired in the width direction in the case of the UTP connection terminals 21A (see FIG. 9) and is increased by locating the resilient contact pieces 32 on widthwise inner sides and locating the receiving portions 31 on widthwise outer side in the accommodating portions 26 paired in the width direction in the case of the STP connection terminals 21B (see FIG. 23). Impedance is adjusted merely by reversing the positional relationship of the resilient contact pieces 32 and the receiving portions 31 between the UTP connector 20A and the STP connector 20B. Thus, it is not necessary to apply special processing and cost can be reduced further.

Other embodiments are described briefly.

Although both the UTP dielectric and the STP dielectric are vertically dividable in the above embodiment, at least one of the UTP dielectric and the STP dielectric may be formed unitarily to be undividable according to the present invention.

Although the outer conductor of the STP connector is vertically dividable in the above embodiment, the outer conductor may be formed unitarily to be undividable according to the present invention.

The pitch width of the respective accommodating portions of the STP dielectric is larger than that of the respective accommodating portions of the UTP dielectric in the above embodiment. However, the pitch width of the respective accommodating portions of the STP dielectric may be substantially equal to that of the respective accommodating portions of the UTP dielectric. According to this configuration, a difference between the STP dielectric and the UTP dielectric can be made even smaller.

The box may be provided with two or more protrusions projecting in the same direction.

LIST OF REFERENCE SIGNS

10A . . . UTP cable
10B . . . STP cable
11 . . . wire
20A . . . UTP connector
20B . . . STP connector
21A . . . UTP connection terminal
21B . . . STP connection terminal
22A . . . UTP dielectric
22B . . . STP dielectric
26 . . . accommodating portion
27 . . . box
31 . . . receiving portion
32 . . . resilient contact piece
34 . . . protrusion
53 . . . insertion area
90A . . . mating UTP connector
90B . . . mating STP connector
91 . . . male terminal

The invention claimed is:

1. A connector structure, comprising:

UTP (Unshield Twisted Pair) connection terminals each including a box portion and a protrusion, a male terminal being inserted and connected into the box portion, the protrusion projecting outwardly of the box portion, the UTP connection terminals being connected to respective wires of a UTP cable;

STP (Shield Twisted Pair) connection terminals each including a box portion and a protrusion, a male terminal being inserted and connected into the box portion, the protrusion projecting outwardly of the box portion, the STP connection terminals being connected to respective wires of a STP cable;

a UTP dielectric including accommodating portions for accommodating the UTP connection terminals; and an STP dielectric including accommodating portions for accommodating the STP connection terminals;

a pair of the accommodating portions of the UTP dielectric and a pair of the accommodating portions of the STP dielectric being arranged in a width direction perpendicular to an inserting direction of the male terminals;

the UTP connection terminals being arranged in the pair of accommodating portions of the UTP dielectric such that insertion areas for the male terminals in the box portions are spaced apart at a first distance in the width direction;

the STP connection terminals being arranged in the pair of accommodating portions of the STP dielectric such that insertion areas for the male terminals in the box portions are spaced apart at a second distance greater than the first distance in the width direction; and the UTP connection terminals and the STP connection terminals being set such that all of the protrusions are oriented in the same direction in a state accommodated in the corresponding accommodating portions and at the corresponding first and second distances in the first direction.

2. The connector structure of claim 1, wherein:

a receiving portion and a resilient contact piece facing the receiving portion are arranged in the box portion, the resilient contact piece projects more into the box portion than the receiving portion and the male terminal is sandwiched between the receiving portion and the resilient contact piece;

the UTP connection terminals are accommodated in the pair of accommodating portions of the UTP dielectric such that the receiving portions are located on inner sides proximate in the width direction and the resilient contact pieces are located on outer sides spaced apart in the width direction; and the STP connection terminals are accommodated in the pair of accommodating portions of the STP dielectric such that the receiving portions are located on outer sides spaced apart in the width direction and the resilient contact pieces are located on inner side proximate in the width direction.

* * * * *